US007591514B2

(12) United States Patent
Chagnot et al.

(10) Patent No.: US 7,591,514 B2
(45) Date of Patent: Sep. 22, 2009

(54) CUTTER HEAD FOR AN EXCAVATOR MACHINE

(75) Inventors: Philippe Chagnot, Nanterre (FR); Jean-Claude Riglet, Nanterre (FR)

(73) Assignee: Compagnie du Sol, Nanterre (FR)

( * ) Notice: Subject to any disclaimer, the term of this patent is extended or adjusted under 35 U.S.C. 154(b) by 103 days.

(21) Appl. No.: 11/826,498

(22) Filed: Jul. 16, 2007

(65) Prior Publication Data

US 2008/0024001 A1 Jan. 31, 2008

(30) Foreign Application Priority Data

Jul. 28, 2006 (FR) ..... 06 53171

(51) Int. Cl.
*E02F 5/08* (2006.01)

(52) U.S. Cl. ..... 299/78; 175/96; 37/189

(58) Field of Classification Search ..... 299/39.4, 299/78; 175/95, 96; 37/189, 462, 464, 352, 37/91, 365

See application file for complete search history.

(56) References Cited

U.S. PATENT DOCUMENTS 3,290,096 A * 12/1966 Stalker ..... 299/78
5,158,126 A * 10/1992 Lang ..... 144/375
2004/0256908 A1 12/2004 Risi

FOREIGN PATENT DOCUMENTS

| | | | |
|---|---|---|---|
| DE | 2 211 280 | B1 | 4/1973 |
| DE | 195 39 249 | A1 | 4/1996 |
| EP | 0 262 050 | A1 | 3/1988 |
| WO | WO 00/36230 | A | 6/2000 |

* cited by examiner

*Primary Examiner*—Sunil Singh
(74) *Attorney, Agent, or Firm*—Kenyon & Kenyon LLP

(57) ABSTRACT

The invention relates to a cutter head for an excavator machine having at least one cutter motor, each cutter motor comprising: a fastener plate; a mounting structure comprising an end portion and a mounting assembly; a single hydraulic motor mounted in said mounting assembly and having an outlet shaft presenting two ends, said motor and the end portion of the mounting structure being offset in a direction that is orthogonal to said fastener plate; a plurality of conduits formed in the thickness of the fastener plate; and a plurality of ducts formed in said end portion of the mounting structure to connect the hydraulic motor to said conduits.

7 Claims, 3 Drawing Sheets

CUTTER HEAD FOR AN EXCAVATOR MACHINE

The present invention relates to a cutter head for an excavator machine commonly referred to as a cutter.

BACKGROUND OF THE INVENTION

Cutter type excavator machines are usually used for making trenches in the ground to considerable depth, up to 100 meters (m), and of width that is relatively small compared with said depth, the width typically lying in the range 500 millimeters (mm) to 1500 mm. One of the advantages of such machines is to enable such deep trenches to be made while complying with a requirement for being rigorously vertical. The trench of the hole is obtained by successively digging adjacent panels.

In general, cutters are constituted by a box structure of considerable height that serves to provide mechanical guidance to the excavator machine as the trench is being made. At the bottom end of the box structure there is a cutter head. These machines are themselves well known and it therefore suffices to mention that the cutter head is usually constituted by two cutter motors each usually carrying a pair of drums on which cutter tools are mounted. Each pair of drums rotates about a common axis, with the two axes of the cutter motors being parallel and horizontal in use. The cutter drums are driven in rotation by hydraulic motors.

Various types of mount are possible. In the configuration adopted in particular by the supplier Bauer, the hydraulic motor is placed inside the box structure above the cutter head. It transmits power via a substantially vertical shaft of small diameter that passes within the thickness of the plate that forms the bearing of the cutter motor. The vertical shaft engages a pair of bevel gears that deliver motion to the horizontal shaft. An epicyclic gear system reduces the speed of rotation and increases torque so as to provide the cutter drums with effective drive.

In another configuration, made available in particular by the supplier Casagrande, the hydraulic motors are located in the bottom portion of the box structure of the machine above the cutter head, and power is transmitted to the cutter drum by a transmission chain.

European patent EP 0 262 050 in the name of Soletanche, discloses a method of driving cutter drums in which the single hydraulic motor is mounted inside the cutter drums and is connected thereto by a stage of reduction gearing, or else by direct transmission. The way in which hydraulic power is applied to the motor is not described.

The first two types of excavator machine mentioned above present the major drawback of having hydraulic motors above the cutter head and thus of mounting those motors in a manner that is more complex and more expensive. In particular, it is not possible to change the cutter heads quickly.

Furthermore, the elements of the drive transmission system for the first two types of cutter (gearing, speed reduction, chain) leads to relatively high losses, of the order of 15%, that do not occur in the configuration described in the European patent in the name of Soletanche.

It should be added that depending on the nature of the work and the terrain being excavated, it can be advantageous to be able to vary the parameters relating to speed of rotation and torque for the cutter drums.

The thickness of the cutter head is determined by the width of the trench to be made and may lie in the range 500 mm to 1500 mm. The present invention relates to an excavator machine of small width, typically lying in the range 500 mm to 800 mm.

It will be understood, that with such small thickness, special problems can arise in providing the means for driving the drum.

OBJECTS AND SUMMARY OF THE INVENTION

An object of the present invention is to provide a cutter head for a cutter type excavator machine that provides better performance in terms of torque and/or speed than prior art machines in an available volume that is determined by the diameter of the cutter drums, generally about 1.4 m, and the thickness of the cutter head, preferably lying in the range 500 mm to 800 mm.

According to the invention, in order to achieve this object, the cutter head for an excavator machine is constituted by at least one cutter motor that comprises:

- a fastener plate;
- a mounting structure comprising an end portion and a mounting assembly;
- a single hydraulic motor mounted in said mounting assembly with an outlet shaft presenting two ends, said motor and the end portion of the mounting structure being offset in a direction orthogonal to said fastener plate;
- a plurality of conduits formed in the thickness of the fastener plate;
- a plurality of ducts formed in said end portion of the mounting structure to connect the hydraulic motor to said conduits;
- two rims for mounting the cutter drum, each rim being drivingly connected to one end of said shaft; and
- two sets of bearings mounted respectively on the outside face of said mounting assembly and on the outside face of the end portion of the mounting structure;
- said bearing mounted on the mounting assembly being disposed at least at in part in register with the hydraulic motor.

It will be understood that by means of the offset between the hydraulic motor mounting assembly and the end portion of the mounting structure that contains the ducts for feeding hydraulic fluid to the hydraulic motor, firstly the hydraulic motor is made accessible from one end of the cutter motor, and secondly the hydraulic motor is fed with hydraulic fluid laterally in favorable manner.

Furthermore, the positions of the bearings enables the size of the cutter motor to be minimized along the axis of the shaft of the hydraulic motor.

Preferably, the cutter motor further includes two rims for mounting cutter drums, each rim being drivingly connected to one end of said shaft, and two bearing assemblies mounted respectively on the outside face of said mounting assembly and on the outside face of the end portion of the mounting structure.

Also preferably, the cutter motor further includes a system for controlling variation in the cylinder capacity of the hydraulic motor under the control of fluid conveyed by one of said conduits and one of said ducts.

BRIEF DESCRIPTION OF THE DRAWINGS

Other characteristics and advantages of the invention appear better on reading the following description of an embodiment of the invention given by way of non-limiting example. The description refers to the accompanying figures, in which.

MORE DETAILED DESCRIPTION

Figure 1A:
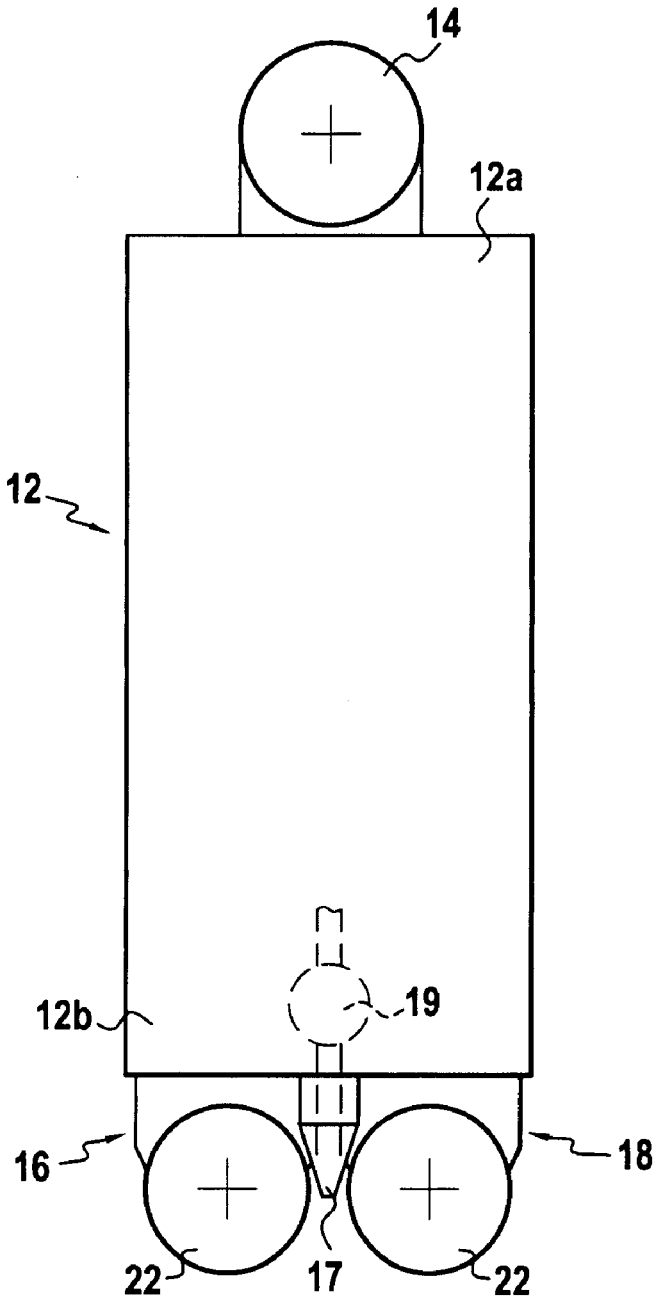
FIGS. 1A and 1B are overall views of an excavator machine of the cutter type shown in elevation view and in side view.
Figure 1B:
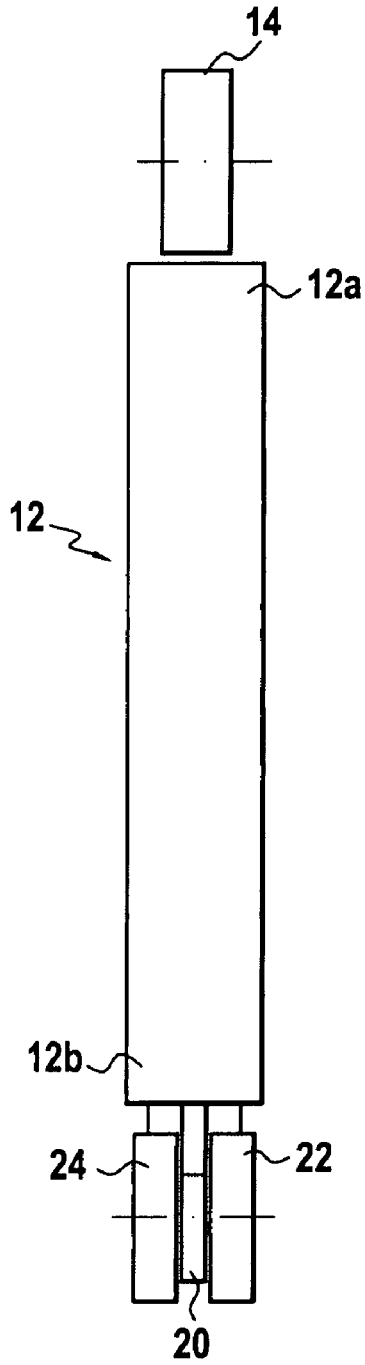

FIGS. 1A and 1B are simplified views showing the overall shape of a cutter type excavator machine. The machine is constituted by a relatively long box structure 12 of horizontal section that is substantially rectangular. The top end 12*a* of the box structure is fitted with pulleys 14 over which tackle passes to support the cutter 12. At the bottom end 12*b* of the box structure 12 there are two identical cutter motors 16 and 18 forming a cutter head. Each cutter motor 16 or 18 is essentially constituted by a fastener plate 20 having mounted thereon two cutter drums 22 and 24 symmetrically about the midplane of the fastener plate 20. The invention relates to applying rotary drive to the cutter drums 22, 24 of the cutter motors 16 and 18.

There are also shown the nozzle 17 for sucking in the ground cuttings, and the pump 19 for applying the suction force.

Figure 2:
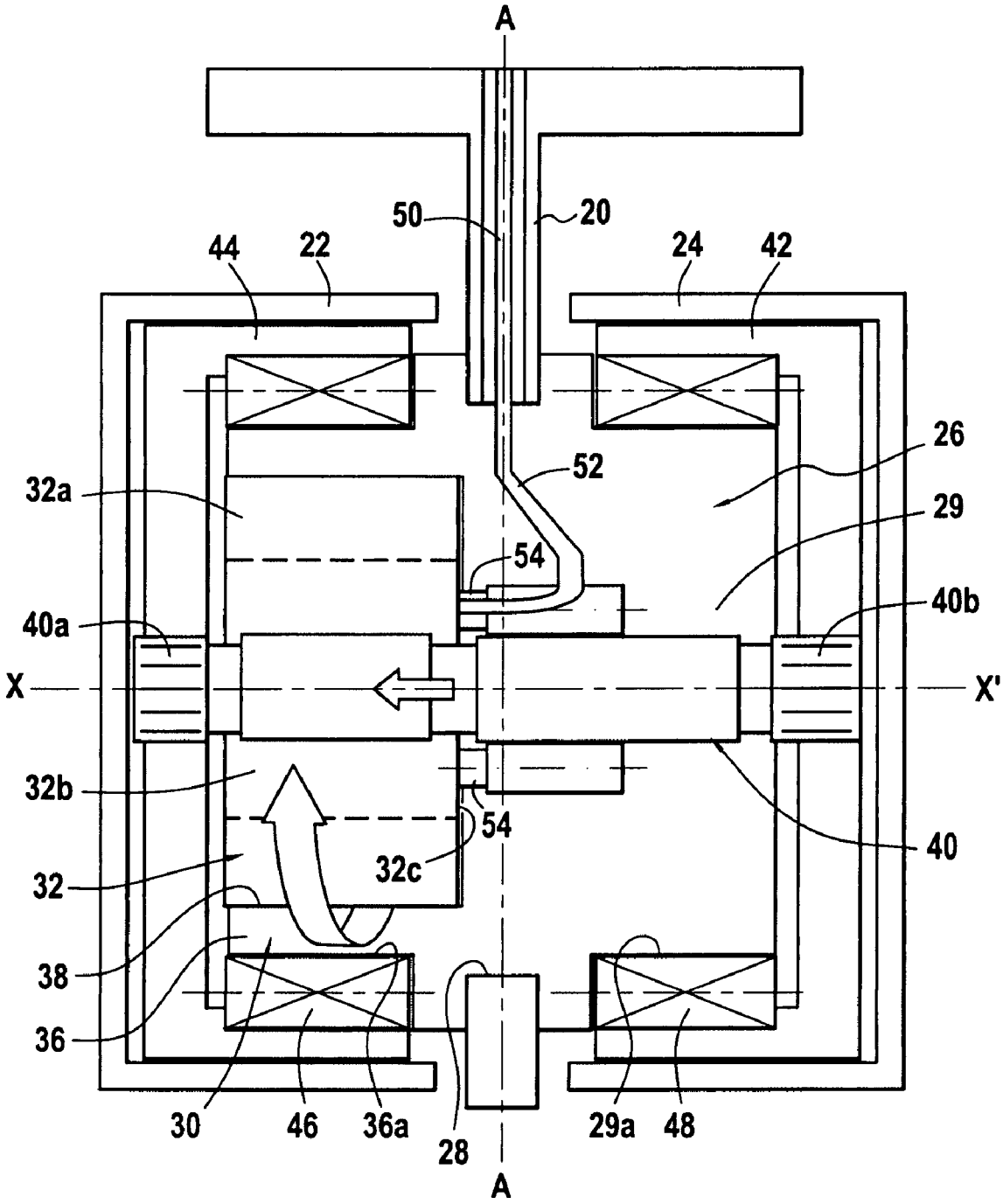
FIG. 2 is a vertical section view of a cutter motor showing its essential elements.

With reference to FIG. 2, there follows a description of the general organization of how a pair of cutter drums 22, 24 constituting a cutter motor are driven in rotation.

The cutter motor 16 comprises a mounting structure 26 that is secured to the fastener plate 20 and that is engaged in a preferably circular orifice 28 of axis XX' formed in said plate. The mounting structure 26 has an end portion 29 for receiving the ducts for feeding the hydraulic motor, as explained below, and a mounting assembly 30 for receiving the hydraulic motor 32. The hydraulic motor 32 comprises a stator 32*a* and a rotor 32*b*. The end portion 29 and the mounting assembly 30 are offset from the midplane along the axis of rotation XX' of the cutter drums. The mounting structure 26 is secured to the fastener plate 20 and is engaged in the preferably circular orifice 28 thereof.

In the example shown in FIG. 2, the hydraulic motor 32 is disposed entirely on one side of the midplane of the fastener plate 20. In other circumstances, the hydraulic motor 32 could extend in part into the other side of the midplane.

Preferably, the mounting assembly 30 is constituted by a cylindrical bushing that extends from one side of the end portion 29 and that defines a cylindrical cavity 38 for receiving the hydraulic motor 32, which motor is fastened by means of its stator 32*a* to the bushing. The cavity opens out at one end of the cutter motor thus making the hydraulic motor 32 easily accessible.

The hydraulic motor 32 rotates a shaft 40 that extends along the axis XX' over the entire width of the cutter motor.

The cutter drums are rotated by the shaft 40 via two rims 42 and 44 secured to respective ends 40*a* and 40*b* of the shaft 40 of the hydraulic motor. The cutter drums are mounted on the outside faces of the rims 42 and 44.

The bearings 46 and 48 are interposed firstly between the outside faces 29*a* and 36*a* of the end portion 29 and of the bushing 36, and secondly the rims 42 and 44. The bearings 46 and 48 serve firstly to take up the radial forces that result from the cutters acting on the ground, and secondly to take up the axial forces that result from the way in which the hydraulic motor 32 is fed with hydraulic fluid, as explained below. In addition, these bearings must be capable of taking up the axial forces due to axial thrust that might be applied to the cutter drum as a result of any non-uniformity in the ground in which cutting is taking place.

The bearings 46 are mounted at least in part in register with the hydraulic motor 32. It is thus possible to obtain a cutter motor that is very compact along the direction of its axis. In addition, the stator of the hydraulic motor 32 is fastened directly to the mounting assembly 30, i.e. to the cylindrical bushing 36.

The hydraulic motor 32 and its auxiliary equipment is fed with hydraulic fluid firstly by conduits 50 made in the thickness of the fastener plate 20, and secondly by ducts 52 formed in the end portion 29 of the mounting structure 26, with these ducts being shown symbolically in FIG. 2.

The inside end of each conduit 50 is connected to a first end of a duct 52, with the second ends of the ducts being connected to a distributor face 54 for providing sliding and rotary connection between the ducts and the rotor 32*b* of the hydraulic motor 32.

It will be understood that at the distributor faces 54, the action of the liquid under pressure delivered via some of the ducts 52, and in particular the high pressure feed duct for the hydraulic motor, exerts a large amount of axial thrust on the end face 32*c* of the rotor 32, which thrust needs to be taken up by the bearings 46 and 48.

Figure 3:
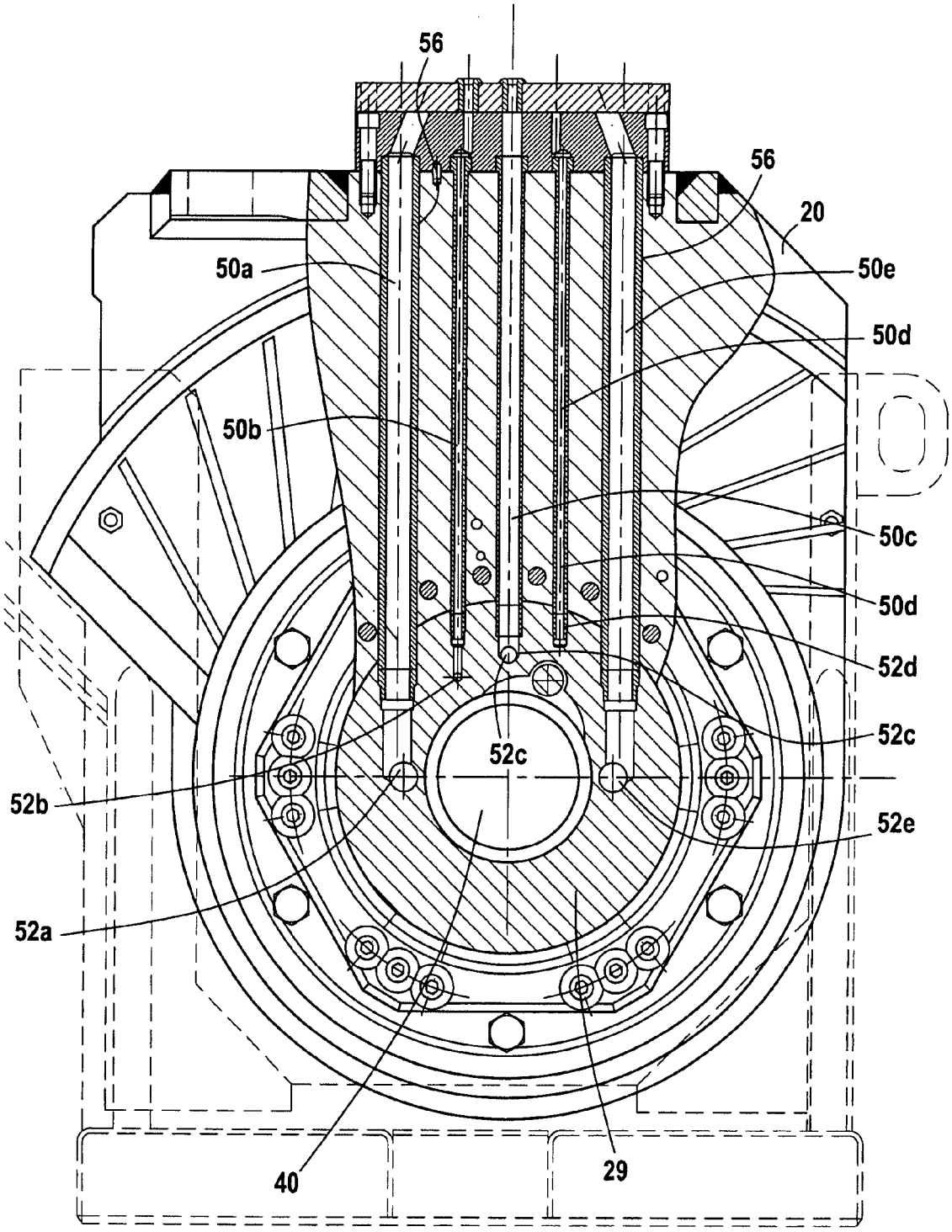
FIG. 3 is a view of a cutter motor in section on line A-A of FIG. 2.

FIG. 3 shows in greater detail one particular embodiment of the cutter motor of the invention.

In FIG. 3, there can be seen the conduits 50*a*, 50*b*, 50*c*, 50*d*, and 50*e* that are formed in the thickness of the fastener plate 20, and also the ducts 52*a*, 52*b*, 52*c*, 52*d*, and 52*e* that are connected thereto.

The conduit 50*a* corresponds to the high pressure feed of the hydraulic motor, the conduit 50*e* corresponds to the low pressure oil outlet from the hydraulic motor.

The conduits 50*b* and 50*c* correspond respectively to draining internal leaks from the hydraulic motor 32 and to balancing the internal pressure of the cutter motor.

Systems for balancing sealing gaskets by pressure are well known in themselves. It is therefore not necessary to describe them herein. Their function is to ensure that drilling mud does not penetrate into the cutter motor itself.

Preferably, the conduits 50*a* to 50*e* formed in the thickness of the fastener plate 50 are lined internally by liners 56 having properties adapted to the liquids that flow in these conduits and to their pressures. When such liners are provided, they also serve to improve sealing.

Another characteristic that also serves to improve compactness along the axis of the hydraulic motor lies in the fact that the fastener plate 20 may be of small thickness, typically of the order of 50 mm to 60 mm.

This is obtained in particular by the fact that the fastener plate includes a circular orifice 28 in which the mounting structure 26 is mounted. In the thickness of the fastener plate 20, there are to be found only the conduits 50 that are rectilinear and that are preferably lined by liners 56. Bend portions form part of the ducts 52 formed in the end portion 29 of the mounting structure. In the end portion 29, there is all the room needed for organizing the ducts 52 and the feed faces of the hydraulic motor.

In addition, the ability to minimize the thickness of the fastener plate satisfies another objective. The cutters cannot act in the zone that corresponds to said thickness unless expensive special arrangements are made.

Also preferably, the cutter motor is fitted with means for controlling variation in the cylinder capacity of the hydraulic motor, which system is not shown in the figures. Cylinder capacity control systems are themselves well known. The conduit 50*d* and the duct 52*d* serve to convey the liquid for controlling the cylinder capacity changer system. In practice, the hydraulic motor 32 presents two possible cylinder capacities.

This disposition enables the torque delivered by the hydraulic motor 32 and transmitted to the cutter drums to be adapted to the characteristics of the ground in which the excavator machine is being used.

What is claimed is:

1. A cutter head for an excavator machine having at least one cutter motor, each cutter motor comprising:

a fastener plate for being fixed to the excavator machine;

a mounting structure secured to the fastener plate and comprising an end portion and a mounting assembly;

a single hydraulic motor mounted in said mounting assembly with an outlet shaft presenting two ends, said motor and the end portion of the mounting structure being offset in a direction orthogonal to said fastener plate;

a plurality of hydraulic conduits formed in the thickness of the fastener plate;

a plurality of hydraulic ducts formed in said end portion of the mounting structure to connect the hydraulic motor to said conduits;

two rims for mounting the cutter drum, one rim being drivingly connected to one end of said shaft, and the other rim being drivingly connected to the other end of said shaft; and two sets of bearings mounted respectively on the outside face of said mounting assembly and on the outside face of the end portion of the mounting structure;

said bearing mounted on the mounting assembly being disposed at least at in part in register with the hydraulic motor.

2. A cutter head according to claim 1, wherein said sets of bearings are also suitable for taking up forces in the axial direction of the cutter motor shaft.

3. A cutter head according to claim 1, including a system for controlling variation in the cylinder capacity of the hydraulic motor under the control of fluid conveyed by one of said conduits and one of said ducts.

4. A cutter head according to claim 1, further including a system for balancing the pressure of sealing gaskets of the cutter motor, said balancing system being fed by one of said conduits and one of said ducts.

5. A cutter head according to claim 1, wherein said mounting assembly comprises a cylindrical bushing defining a cylindrical cavity for receiving said hydraulic motor, said bearings being mounted on the outside face of said cylindrical bushing.

6. A cutter head according to claim 1, wherein said plate presents an orifice in which said mounting structure is engaged and fastened.

7. An excavator machine comprising a cutter head having at least one cutter motor, each cutter head comprising:

a fastener plate for being fixed to the excavator machine;

a mounting structure secured to the fastener plate and comprising an end portion and a mounting assembly;

a single hydraulic motor mounted in said mounting assembly with an outlet shaft presenting two ends, said motor and the end portion of the mounting structure being offset in a direction orthogonal to said fastener plate;

a plurality of hydraulic conduits formed in the thickness of the fastener plate;

a plurality of hydraulic ducts formed in said end portion of the mounting structure to connect the hydraulic motor to said conduits;

two rims for mounting the cutter drum, one rim being drivingly connected to one end of said shaft, and the other rim being drivingly connected to the other end of said shaft;

two sets of bearings mounted respectively on the outside face of said mounting assembly and on the outside face of the end portion of the mounting structure; and said bearing mounted on the mounting assembly being disposed at least at in part in register with the hydraulic motor.

* * * * *